US009169835B2

(12) United States Patent
Takahashi et al.

(10) Patent No.: US 9,169,835 B2
(45) Date of Patent: Oct. 27, 2015

(54) PISTON-TYPE COMPRESSOR

(75) Inventors: Tomoyasu Takahashi, Kumagaya (JP); Takanori Teraya, Kumagaya (JP)

(73) Assignee: VALEO JAPAN CO., LTD., Saitama (JP)

( * ) Notice: Subject to any disclaimer, the term of this patent is extended or adjusted under 35 U.S.C. 154(b) by 493 days.

(21) Appl. No.: 13/638,146

(22) PCT Filed: Mar. 31, 2010

(86) PCT No.: PCT/JP2010/002388
§ 371 (c)(1),
(2), (4) Date: Nov. 7, 2012

(87) PCT Pub. No.: WO2011/121669
PCT Pub. Date: Oct. 6, 2011

(65) Prior Publication Data

US 2013/0042750 A1 Feb. 21, 2013

(51) Int. Cl.
*F04B 39/04* (2006.01)
*F04B 27/08* (2006.01)
(Continued)

(52) U.S. Cl.
CPC ..... *F04B 27/0808* (2013.01); *F04B 27/109* (2013.01); *F04B 27/1009* (2013.01); *F04B 39/0246* (2013.01); *F04B 39/04* (2013.01)

(58) Field of Classification Search
CPC .... F04B 27/109; F04B 27/1018; F04B 27/12; F04B 39/02; F04B 39/0246; F04B 27/0808; F04B 27/1009; F04B 39/04
USPC ..... 92/57, 154
See application file for complete search history.

(56) References Cited

U.S. PATENT DOCUMENTS 4,070,136 A * 1/1978 Nakayama et al. ..... 417/269
4,229,145 A * 10/1980 Isizuka ..... 417/269
(Continued)

FOREIGN PATENT DOCUMENTS

JP 07-317655 A 12/1995
JP 8114947 A 6/1996
(Continued)

OTHER PUBLICATIONS

English language abstract and machine-assisted English translation for JP 07-317655 extracted from the PAJ database on Dec. 28, 2012, 25 pages.
(Continued)

*Primary Examiner* — Edward Look
*Assistant Examiner* — Dustin T Nguyen
(74) *Attorney, Agent, or Firm* — Howard & Howard Attorneys PLLC

(57) ABSTRACT

Provided is a piston type compressor which can enhance cooling of internal parts housed in a crank chamber, while effectively reducing an outflow of oil to the outside of a compressor by effectively performing a centrifugal separating operation due to the rotation of a shaft. The compressor includes: a first suction path which directly introduces a working fluid flowed from a suction port 30 into suction chambers 27*a*, 27*b* without via the crank chamber 7; and a second suction path which introduces the working fluid flowed from the suction port 30 into the suction chambers 27*a*, 27*b* via the crank chamber 7, and the second suction path includes: an oil separation passage 32 where a working fluid is introduced into the suction chambers 27*a*, 27*b* from the crank chamber 7 via holes formed in the shaft; and a bypass passage 33 where the working fluid is introduced into the suction chambers 27*a*, 27*b* from the crank chamber 7 through the cylinder blocks 1, 2 without via the shaft 12.

7 Claims, 5 Drawing Sheets

(51) Int. Cl.
*F04B 39/02* (2006.01)
*F04B 27/10* (2006.01)

(56) References Cited

U.S. PATENT DOCUMENTS

| | | | | | |
|---|---|---|---|---|---|
| 4,321,019 | A * | 3/1982 | Degawa et al. | ..... | 417/269 |
| 4,413,954 | A * | 11/1983 | Okazaki | ..... | 417/269 |
| 5,044,892 | A * | 9/1991 | Pettitt | ..... | 417/269 |
| 5,820,355 | A | 10/1998 | Ikeda et al. | | |
| 7,281,905 | B2 * | 10/2007 | Saiki et al. | ..... | 417/269 |
| 8,118,566 | B2 * | 2/2012 | Takahashi et al. | ..... | 417/269 |
| 2009/0238697 | A1 * | 9/2009 | Sato et al. | ..... | 417/269 |

FOREIGN PATENT DOCUMENTS

| | | | | | |
|---|---|---|---|---|---|
| JP | 2008-025476 | A | | 2/2008 | |
| JP | WO2008056533 | | * | 5/2008 | ..... F04B 27/08 |
| JP | 2009-108750 | A | | 5/2009 | |
| JP | 2010-223102 | A | | 10/2010 | |
| WO | WO 2008-056533 | A1 | | 5/2008 | |

OTHER PUBLICATIONS

English language abstract for JP 8114947 extracted from the espacenet.com database on Dec. 27, 2012, 7 pages.
English language abstract and machine-assisted English translation for JP 2008-025476 extracted from the PAJ database on Dec. 27, 2012, 37 pages.
English language abstract and machine-assisted English translation for JP 2009-108750 extracted from the PAJ database on Dec. 27, 2012, 34 pages.
English language abstract and machine-assisted English translation for JP 2010-223102 extracted from the espacenet.com and PAJ databases on Dec. 28, 2012, 37 pages.
English language abstract for WO 2008-056533 extracted from the espacenet.com database on Dec. 27, 2012, 33 pages.
International Search Report for Application No. PCT/JP2010/002388 dated Jun. 29, 2010, 3 pages.

* cited by examiner

PISTON-TYPE COMPRESSOR

RELATED APPLICATIONS

This application is the National Stage of International Patent Application No. PCT/JP2010/002388, filed on Mar. 31, 2010.

TECHNICAL FIELD

The present invention relates to a piston-type compressor having the structure which can separate oil mixed into a working fluid on a working fluid path in the inside of the compressor, and more particularly to a compressor used in an air conditioner for a vehicle and having a working fluid path which introduces a working fluid sucked from a suction port into a suction chamber through a crank chamber and discharges the working fluid from a discharge port through a discharge chamber after compressing the working fluid by pistons.

BACKGROUND ART

In a compressor used in a refrigerating cycle, when oil flows out to an external cycle from the compressor, not only is a shortage of oil in the compressor brought about, but also the oil circulates in a cycle together with a refrigerant thus giving rise to a drawback that refrigerating efficiency is lowered.

To avoid such a drawback, the applicant of the present application previously proposed a compressor having the constitution where a working fluid is introduced into a suction chamber from a suction port through a crank chamber. To explain the constitution of the compressor, in a shaft which penetrates the crank chamber, at least an axial hole and a side hole are formed. The axial hole extends along the axial direction of the shaft, and the side hole communicates with the axial hole, extends along the radial direction of the shaft and opens to the crank chamber. A working fluid which flows into the crank chamber is introduced into the suction chamber through at least the side hole and the axial hole, and by making use of a centrifugal separating operation generated due to the rotation of the shaft, any oil in the working fluid which flows into the suction chamber from the crank chamber is separated when the working fluid flows through the side hole opening to the crank chamber (see patent document 1).

However, in such constitution, in an attempt to introduce a total quantity of working fluid flowed from the suction port into the suction chamber by allowing the working fluid to pass through the side hole and the axial hole formed in the shaft, a flow speed of the working fluid becomes fast at an inlet of the side hole formed in the shaft so that the centrifugal separating operation does not function effectively. Accordingly, oil mixed into the working fluid is sucked out to the suction chamber and, eventually, a quantity of oil discharged to the outside of the compressor cannot be sufficiently suppressed.

In view of the above, the applicant of the present application has proposed the constitution where, in addition to a suction path where a working fluid which flows into a crank chamber is allowed to pass through a shaft and is introduced into a suction chamber, there is provided another suction path where the working fluid which is sucked from a suction port is introduced into the suction chamber without via the crank chamber so that a part of the sucked working fluid is made to pass through the inside of the shaft from the crank chamber and a remaining part of the sucked working fluid is directly introduced into the suction chamber (see patent document 2).

Due to such constitution, a flow speed of the working fluid which is sucked from a side hole formed in the shaft slows down so that a sufficient oil separation function can be acquired.

CITATION LIST

Patent Literature

[PTL 1] JP-A-2008-25476
[PTL 2] WO 2008/056533 A1

SUMMARY OF INVENTION

Technical Problem

However, in the above-mentioned constitution which introduces only a part of the working fluid into the crank chamber, a quantity of working fluid which is introduced into the crank chamber becomes small and hence, the constitution is disadvantageous with respect to a point that sliding parts in the inside of the crank chamber is cooled by the working fluid which flows into the crank chamber. Further, the constitution has a drawback that when a slide part is worn in the inside of the crank chamber under a high temperature, it is difficult to remove abrasion powder generated by wear by the flow of the working fluid.

The present invention has been made in view of the above-mentioned circumstances, and it is a main object of the present invention to provide a piston type compressor which can enhance cooling of internal parts housed in a crank chamber thus suppressing wear of a slide part such as a bearing, while effectively reducing an outflow of oil to the outside of the compressor by effectively performing a centrifugal separating operation due to the rotation of a shaft.

Further, it is another object of the present invention to provide a piston type compressor which can remove abrasion powder when a slide part in the crank chamber is worn thus suppressing an adverse effect caused by the adhesion of abrasion powder to the slide part.

Means to Solve the Problem

To achieve the above-mentioned object, based on the understanding that although a flow rate of a working fluid which flows in a shaft from a crank chamber may be reduced for effectively performing a centrifugal separating operation due to the rotation of the shaft, a cooling effect in the inside of the crank chamber is deteriorated when a quantity of working fluid supplied to the crank chamber is reduced, inventors of the present invention have made extensive studies on the constitution which can reduce a flow rate of the working fluid which flows into the inside of the shaft while ensuring a flow rate of a refrigerant supplied to the crank chamber and have completed the present invention.

That is, a piston-type compressor according to the present invention includes: at least one cylinder block in which cylinder bores which face a crank chamber are formed; pistons which each slides in the inside of the cylinder bore in a reciprocating manner; at least one cylinder head in which a suction chamber and a discharge chamber are formed, the cylinder head being jointed to the cylinder block by interposing a valve plate therebetween; a shaft which penetrates the crank chamber and is rotatably supported on the cylinder block; a swash plate which is housed in the crank chamber and is rotatable due to the rotation of the shaft so as to reciprocate the pistons; and a suction port and a discharge port which are formed in the cylinder block or the cylinder head and sucks and discharges a working fluid respectively, wherein the working fluid which is sucked from the suction port is introduced into the suction chamber, and is discharged from the discharge port through the discharge chamber after being compressed by the pistons, being characterized in that at least an axial hole which is formed along the axial direction of the shaft; and a side hole which communicates with the axial hole and is formed along the radial direction of the shaft and opens to the crank chamber are formed in the shaft, a first suction path which directly introduces the working fluid flowed from the suction port into the suction chamber without via the crank chamber is provided; and a second suction path which introduces the working fluid flowed from the suction port into the suction chamber via the crank chamber is provided, and the second suction path includes: an oil separation passage where a working fluid is introduced into the suction chamber from the crank chamber via the side hole and the axial hole formed in the shaft; and a bypass passage where a working fluid is introduced into the suction chamber from the crank chamber through the cylinder block without via the inside of the shaft.

In this manner, the second suction path which introduces a working fluid into the suction chamber from the crank chamber is constituted by providing the bypass passage and the oil separation passage parallel to each other. Accordingly, compared to the conventional constitution where the whole working fluid which is introduced into the crank chamber is introduced into the suction chamber only via the shaft (only via the oil separation passage), a quantity of working fluid which flows into the crank chamber can be increased and hence, the cooling of the inside of the crank chamber can be accelerated. Further, the working fluid which is introduced into the crank chamber is introduced into the suction chamber in a divided manner through the bypass passage and the oil separation passage and hence, even when a quantity of working fluid which is introduced into the crank chamber is increased, a quantity of working fluid (a flow speed of the working fluid) which passes through the side hole formed in the shaft is not increased whereby there is no possibility that oil separation function is deteriorated when the working fluid passes through the shaft.

Accordingly, it is possible to make oil remain in the crank chamber by maintaining a centrifugal separating operation generated due to the rotation of the shaft while ensuring cooling of the inside of the crank chamber.

Here, the bypass passage may preferably be formed between a thrust bearing which rotatably supports the swash plate and a thrust bearing receiving surface which receives the thrust bearing and is formed on the cylinder block, and more specifically, may preferably be formed by providing a groove formed on the thrust bearing receiving surface which receives a thrust race of the thrust bearing.

In such constitution, particularly, the groove which forms a part of the bypass passage for allowing the flow of the working fluid into the suction chamber from the crank chamber is formed between the thrust bearing whose cooling is liable to become insufficient and the thrust bearing receiving surface which is formed on the cylinder block. Accordingly, an area in the vicinity of the thrust bearing can be preferentially cooled so that the wear of the thrust bearing and the wear of the thrust bearing receiving surface which receives the thrust bearing can be reduced. Further, it is also possible to discharge abrasion powder which may be generated in the vicinity of the thrust bearing from the crank chamber via the bypass passage.

As the specific constitution of such a bypass passage, the bypass passage may preferably be constituted of: a groove which is formed between a thrust bearing which rotatably supports the swash plate and the thrust bearing receiving surface formed on the cylinder block; a space which communicates with the groove and is formed between the shaft and a shaft insertion hole into which the shaft is inserted; and a through hole which is formed in the cylinder block in a state where the through hole opens in an inner peripheral surface of the shaft insertion hole.

In the above-mentioned constitution, by adopting the intricate structure with respect to the bypass passage, in addition to the above-mentioned manner of operation and advantageous effects, it is possible to eliminate a possibility that oil flows out from the crank chamber.

Particularly in the constitution where the shaft is rotatably supported on the housing by way of a plain bearing, the bypass passage may preferably be formed in the cylinder block such that the bypass passage bypasses a plain bearing.

In the constitution where the shaft is supported on the housing by way of the plain bearing, when abrasion powder generated on a sliding portion in the inside of the crank chamber adheres to the plain bearing, there arises a drawback that the smooth rotation of the shaft is impaired. However, by adopting the above-mentioned constitution, a possibility that abrasion powder generated on the sliding portion in the inside of the crank chamber is introduced to the plain bearing by a working fluid which flows via the bypass passage is eliminated and hence, the above-mentioned drawback can be obviated.

Further, it is preferable that at least one through hole be formed on a side opposite to a portion where a working fluid flows into the crank chamber with respect to an axis of the shaft. By adopting such constitution, when a plurality of grooves which constitute the bypass passage are provided, it is possible to introduce a working fluid which flows into the crank chamber uniformly into the plurality of grooves without being biased to some grooves.

Advantageous Effects of Invention

As explained above, according to the present invention, the piston-type compressor includes the first suction path which directly introduces a working fluid sucked by the compressor into the suction chamber without via the crank chamber and the second suction path which introduces the working fluid into the suction chamber via the crank chamber, and the second suction path is constituted of the oil separation passage which introduces the working fluid into the suction chamber via the shaft and the bypass passage which is arranged parallel to the oil separation passage and introduces the working fluid into the suction chamber through the cylinder block without via the shaft. Accordingly, the increase of the working fluid which is introduced into the suction chamber via the shaft can be suppressed while relatively increasing the working fluid introduced into the crank chamber and hence, the cooling of inner parts in the inside of the crank chamber can be ensured, and separation of oil by a centrifugal separating operation generated due to the rotation of the shaft can be ensured by suppressing a flow speed of the working fluid which flows through the side hole which is formed in the shaft and opens to the crank chamber.

Accordingly, the reliability of the sliding parts in the inside of the crank chamber can be ensured, and also a quantity of oil sucked out from the crank chamber can be reduced.

Particularly, by constituting the bypass passage such that the bypass passage includes the groove formed between the thrust bearing which rotatably supports the swash plate and the thrust bearing receiving surface which receives the thrust bearing and is mounted on the cylinder block, an area particularly in the vicinity of the thrust bearing where cooling is liable to become insufficient can be preferentially cooled and hence, the reduction of the wear of the portion can be realized.

Further, in the constitution where the shaft is rotatably supported on the housing by way of the plain bearing, by forming the bypass passage on the housing such that the bypass passage bypasses the plain bearing, abrasion powder generated in the vicinity of the plain bearing is introduced and discharged by the working fluid which flows in the bypass passage so that the smooth rotation of the shaft can be ensured.

REFERENCE SIGNS LIST

Figure 1:
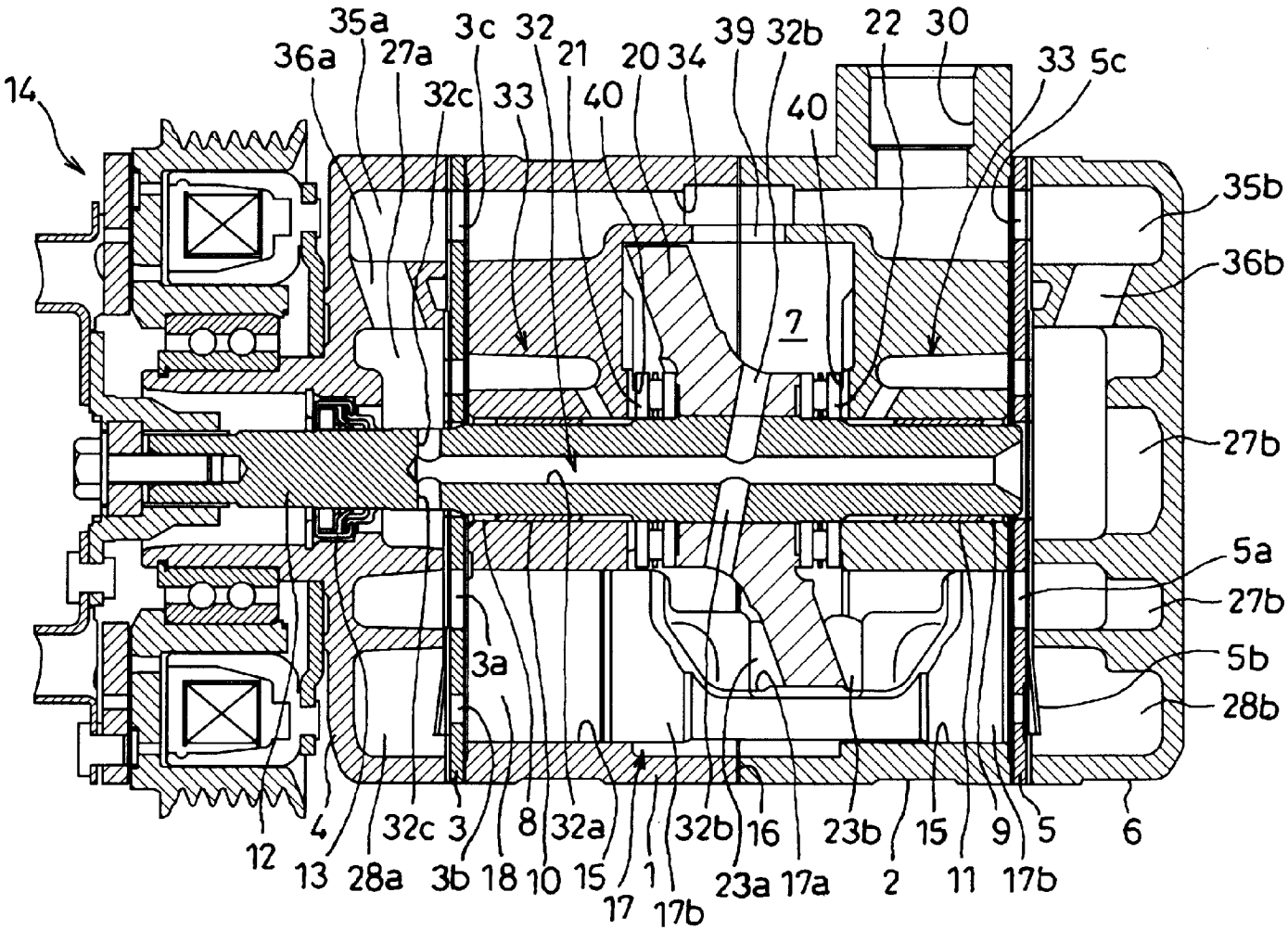
FIG. 1 is a cross-sectional view showing a constitutional example of a piston-type compressor according to the present invention.

1: front-side cylinder block
2: rear-side cylinder block
4: front head
6: rear head
7: crank chamber
8, 9: shaft insertion hole
10, 11: plain bearing
12: shaft
15: cylinder bore
17: piston
20: swash plate
21, 22: thrust bearing
27*a*, 27*b*: suction chamber
28*a*, 28*b*: discharge chamber
30: suction port
31: discharge port
32: oil separation passage
32*a*: axial hole
32*b*: inflow-side side hole
32*c*: outflow-side side hole
33: bypass passage
40: thrust bearing receiving surface
41: groove
42: space
43: block through hole

DESCRIPTION OF EMBODIMENTS

Hereinafter, an embodiment of the present invention is explained in conjunction with attached drawings.

FIG. 1 shows a piston-type compressor which is referred to as a fixed-displacement swash plate reciprocating-type compressor and is used in a refrigerating cycle of a air conditioner for a vehicle where a refrigerant is used as a working fluid.

This compressor is constituted of: a front-side cylinder block 1, a rear-side cylinder block 2 which is assembled to the front-side cylinder block 1; a front head 4 which is assembled to a front side (left side in the drawing) of the front-side cylinder block 1 with a valve plate 3 sandwiched therebetween; and a rear head 6 which is assembled to a rear side (right side in the drawing) of the rear-side cylinder block 2 with a valve plate 5 sandwiched therebetween. The front head 4, the front-side cylinder block 1, the rear-side cylinder block 2 and the rear head 6 are fastened together in the axial direction using fastening bolts not shown in the drawing thus constituting a housing of the whole compressor.

Figure 2:
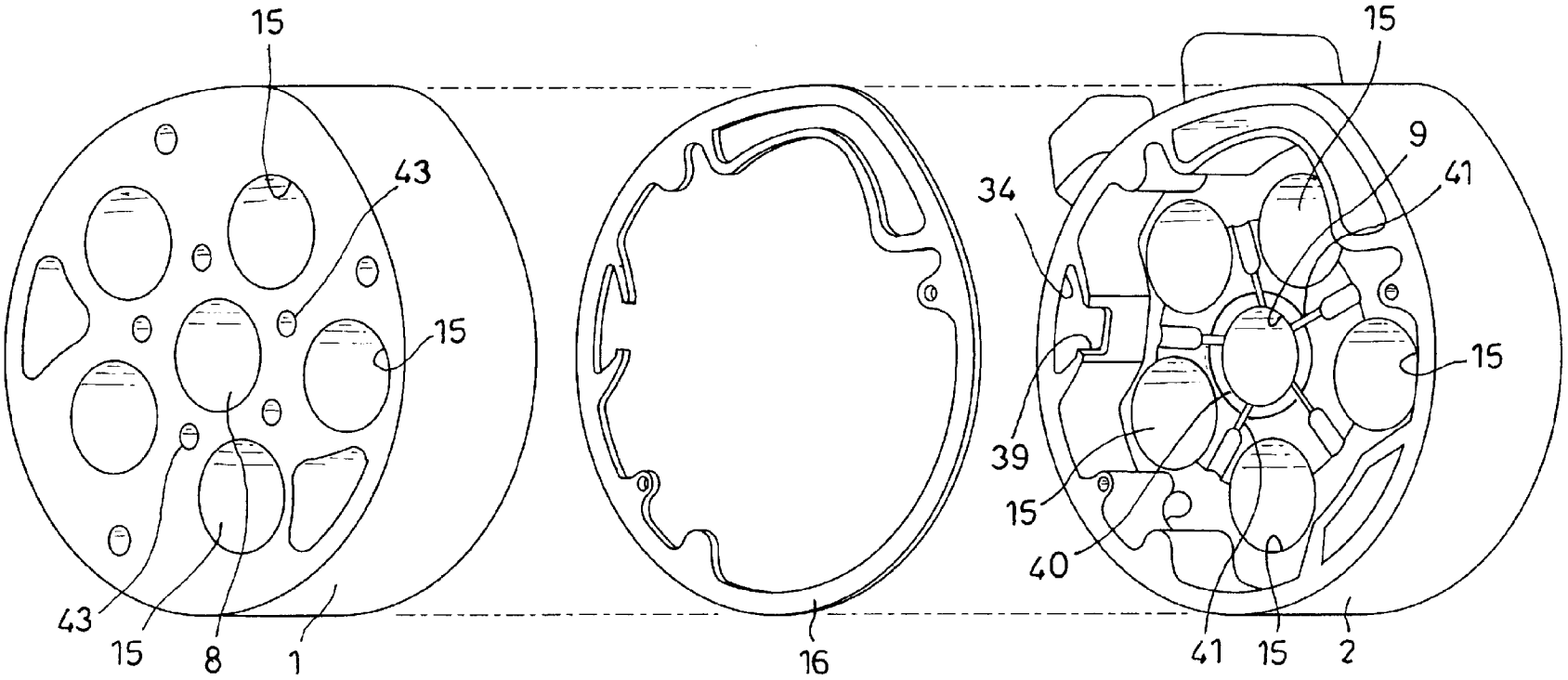
FIG. 2 is a perspective view showing a front-side cylinder block and a rear-side cylinder block of the piston-type compressor according to the present invention.

The front-side cylinder block 1 and the rear-side cylinder block 2 are, also as shown in FIG. 2, assembled together with a gasket 16 sandwiched therebetween, and a crank chamber 7 which is defined by assembling the respective cylinder blocks together is formed in the assembled body. In the crank chamber 7, a shaft 12 is arranged in such a manner that the shaft 12 is rotatably supported on shaft insertion holes 8, 9 formed in the front-side cylinder block 1 and the rear-side cylinder block 2 respectively by way of bearings formed of plain bearings 10, 11, and one end of the shaft 12 projects from the front head 4. The plain bearings 10, 11 are mounted at positions where the plain bearings 10, 11 do not obstruct the formation of side holes of an in-shaft passage described later. A seal member 13 for preventing leakage of a refrigerant is arranged between a distal end portion of the shaft 12 and the front head 4, and an electromagnetic clutch 14 is mounted on a distal end of the shaft 12 which projects from the front head 4.

Figure 3:
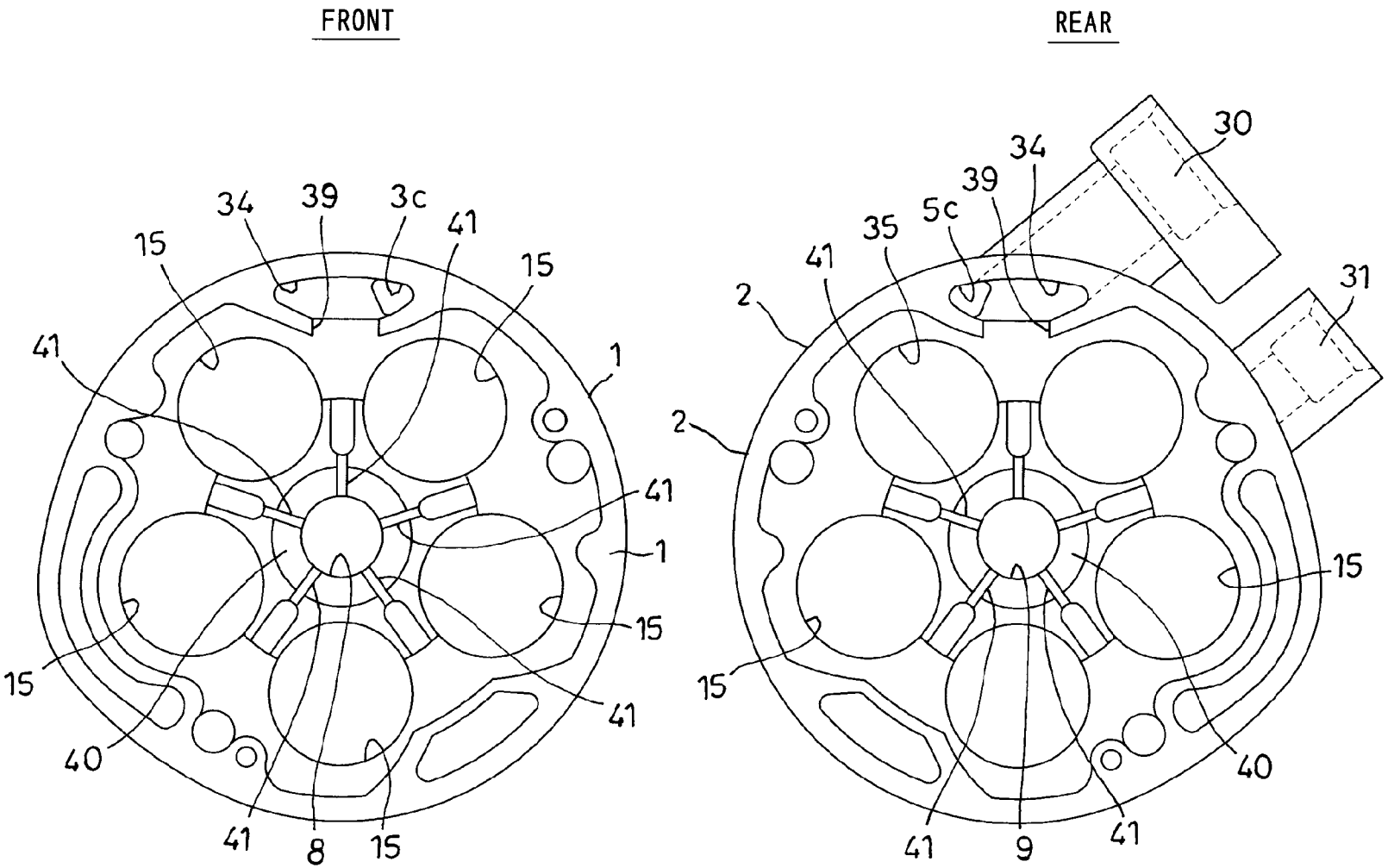
FIG. 3 is a view of the front-side cylinder block and the rear-side cylinder block of the piston-type compressor according to the present invention as viewed from a crank chamber side.

Also as shown in FIG. 3, a plurality of cylinder bores 15 are formed in the cylinder blocks 1, 2 respectively in such a manner that the cylinder bores 15 are arranged parallel to the shaft insertion holes 8, 9 and are equidistantly arranged in the circumferential direction about the shaft. A double-headed piston 17 which has a head portion 17*b* on both ends thereof respectively is inserted in each cylinder bore 15 in a reciprocating manner, and compression chambers 18 are defined between the head portions 17*b* of the double-headed piston 17 and the valve plates 3, 5.

The shaft 12 is housed in the crank chamber 7, and a swash plate 20 which is rotated together with the shaft 12 is integrally formed with the shaft 12.

The swash plate 20 is rotatably supported on the front-side cylinder block 1 and the rear-side cylinder block 2 by way of thrust bearings 21, 22, and is engaged with engaging recessed portions 17*a* which are formed on a center portion of the double-headed piston 17 by way of a pair of semispherical shoes 23*a*, 23*b* which have peripheral portions thereof formed so as to sandwich the swash plate 20 in the longitudinal direction. Accordingly, when the shaft 12 is rotated so that the swash plate 20 is rotated, the rotational movement of the swash plate 20 is converted into the reciprocating movement of the double-headed piston 17 by way of the shoes 23*a*, 23*b* so that a volume of the compression chamber 18 is changed.

Figure 4:
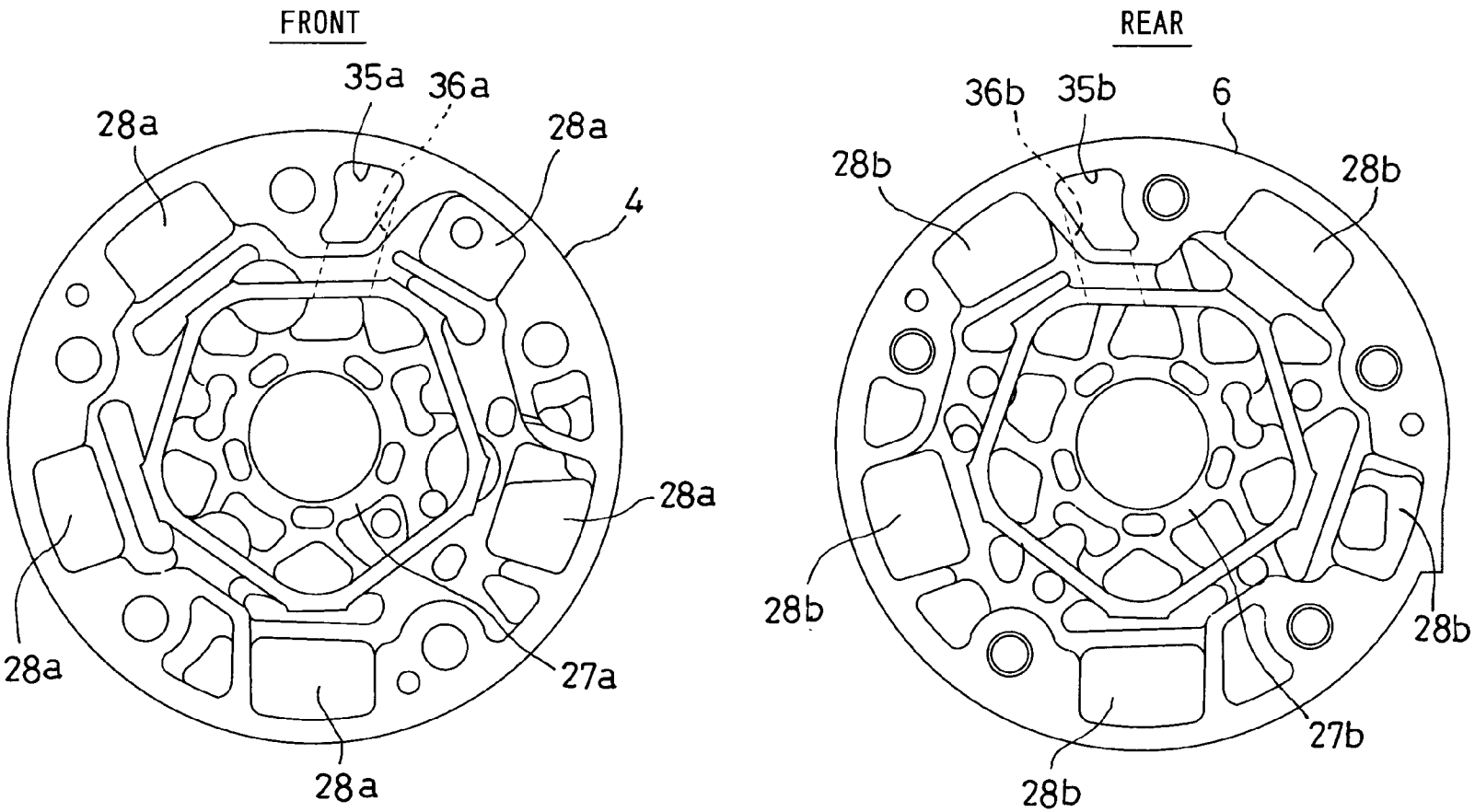
FIG. 4 is a view of a front head and a rear head of the piston-type compressor according to the present invention as viewed from a cylinder block side.

In each valve plate 3, 5, suction holes 3*a*, 5*a* which are opened or closed by suction valves mounted on a cylinder-block-side end surface and discharge holes 3*b*, 5*b* which are opened or closed by discharge valves mounted on a cylinder-head-side end surface are formed corresponding to the respective cylinder bores. Further, also as shown in FIG. 4, in the front head 4 and the rear head 6, suction chambers 27*a*, 27*b* for storing a refrigerant to be supplied to the compression chamber 18 and discharge chambers 28*a*, 28*b* for storing a refrigerant to be discharged from the compression chamber 18 are respectively formed. In this embodiment, the suction chambers 27*a*, 27*b* are formed in the substantially center of the heads 4, 6 respectively, and the discharge chambers 28*a*, 28*b* are formed around the suction chambers 27*a*, 27*b*.

A suction port 30 for sucking a refrigerant from an external cycle and a discharge port 31 which communicates with the discharge chambers 28*a*, 28*b* and discharges a compressed refrigerant are formed in the rear-side cylinder block 2 which constitutes the housing.

In this embodiment, a suction path from the suction port 30 to the suction chambers 27*a*, 27*b* is constituted of: a first suction path which directly introduces a refrigerant flowed from the suction port 30 into the suction chambers 27*a*, 27*b* without via the crank chamber 7; and a second suction path which introduces a refrigerant into the suction chambers via the crank chamber 7 which communicates with the suction port 30. Further, the second suction path is constituted of: an oil separation passage 32 which reaches the suction chambers 27*a*, 27*b* formed in the front head 4 and the rear head 6 respectively via an in-shaft passage formed in the shaft 12 which penetrates the crank chamber 7; and bypass passages 33 which are formed parallel to the oil separation passage 32 and reach the suction chambers 27*a*, 27*b* from the crank chamber 7 through the cylinder blocks 1, 2 by bypassing the shaft 12.

To be more specific, an axial passage 34 which is connected with the suction port 30 and extends in the axial direction is formed outside the crank chamber 7, and the first suction path is formed as follows. The axial passage 34 which is formed outside the crank chamber 7 extends to and over the front head 4 and the rear head 6, and communicates with introduction chambers 35*a*, 35*b* which are formed in the front head 4 and the rear head 6 through the through holes 3*c*, 5*c* formed in the valve plates 3, 5 respectively. Radial passages 36*a*, 36*b* are respectively radially formed in the front head 4 and the rear head 6 such that the radial passages 36*a*, 36*b* do not interfere with the discharge chambers 28*a*, 28*b*, and the introduction chambers 35*a*, 35*b* and the suction chambers 27*a*, 27*b* are connected with each other by the radial passages 36*a*, 36*b*. Due to such a constitution, a part of a refrigerant sucked from the suction port 30 is introduced into the suction chambers 27*a*, 27*b* arranged in the front and rear portions of the compressor without via the crank chamber 7.

In the second suction path, an opening portion 39 which communicates with the crank chamber 7 is formed in the midst of the axial passage 34. A working fluid is introduced into the crank chamber from the opening portion 39 and, thereafter, is introduced into the suction chamber. The oil separation passage 32 is constituted of: an axial hole 32*a* which is formed in the shaft 12 in the axial direction from a rear-side distal end to a front side and has a rear-side opening end thereof opened in the suction chamber 27*b* formed in the rear head 6; inflow-side side holes 32*b* which communicate with the axial hole 32*a*, are radially formed in the shaft 12 and open to the crank chamber 7; and outflow-side side holes 32*c* which communicate with the axial hole 32*a*, are radially formed in the shaft 12, and open in the suction chamber 27*a* formed in the front head 4.

Figure 5:
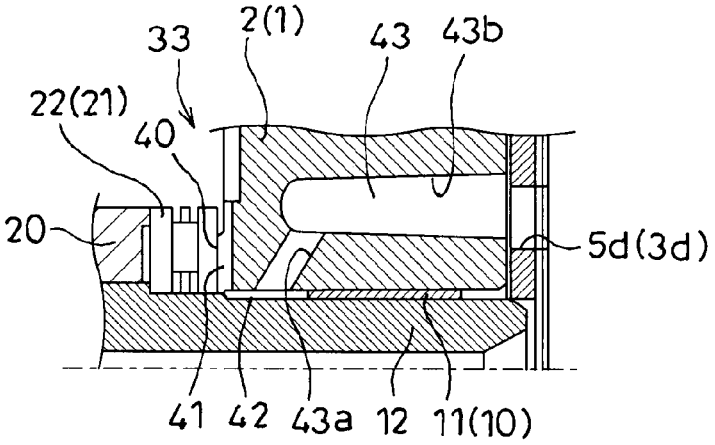
FIG. 5 is an enlarged cross-sectional view showing a bypass passage.

On the other hand, the bypass passage 33 is, as also shown in FIG. 5, constituted of: grooves 41 which are formed between the thrust bearing 21, 22 which rotatably supports the swash plate 20 and a thrust bearing receiving surface 40 formed on the cylinder block 1, 2 which receives the thrust bearing 21, 22; a space 42 formed between the shaft 12 and the shaft insertion hole 8, 9 into which the shaft 12 is inserted; and block through holes 43 which are formed in the cylinder block 1, 2 in such a manner that one end of each block through hole 43 opens on an inner wall surface of the shaft insertion hole 8, 9, and the other end of each block through hole 43 communicates with the suction chamber 27*a*, 27*b* via the through hole 3*d*, 5*d* which is formed in the valve plate 3, 5.

Figure 6:
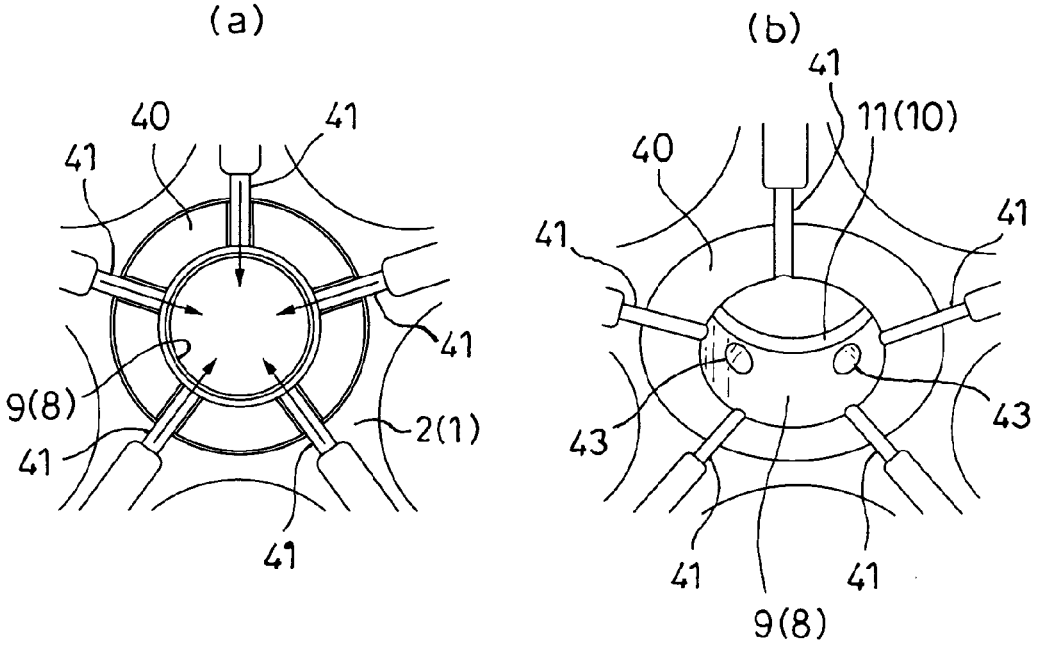
FIG. 6(*a*) and FIG. 6(*b*) are views of the bypass passage as viewed from the crank chamber side, wherein FIG. 6(*a*) is a view of the bypass passage as viewed from the axial direction of a shaft, and FIG. 6(*b*) is a perspective view of the bypass passage.

To be more specific, the grooves 41 are, as also shown in FIG. 6, formed such that grooves are radially formed on the thrust bearing receiving surface 40 of the cylinder block 1, 2 with which a thrust race of the thrust bearing 21, 22 is brought into contact, and the radially formed grooves 41 are formed from a portion of the thrust bearing receiving surface 40 outside a portion of the thrust bearing receiving surface 40 with which the thrust race of the thrust bearing 21, 22 is brought into contact to the shaft insertion hole 8, 9. In this embodiment, out of five cylinder bores 15 which are formed approximately equidistantly in the circumferential direction, the groove 41 is formed between the respective neighboring cylinder bores.

Further, the block through hole 43 has one end thereof opened on an inner peripheral surface of the shaft insertion hole 8, 9 on a front side (crank chamber side) of the plain bearing 10, 11 which rotatably supports the shaft 12 and hence, a working fluid which passes through the grooves 41 and flows out through the space 42 between the shaft 12 and the shaft insertion hole 8, 9 is introduced into the suction chamber 27*a*, 27*b* by bypassing the plain bearing 10, 11.

In this embodiment, the block through hole 43 is constituted of: a plurality of bottomed parallel holes (cast holes) 43*b* which are formed in the cylinder block 1, 2 from a side opposite to the crank chamber approximately parallel to an axis of the shaft 12; and inclined holes 43*a* which are formed in an inner peripheral surface of the shaft insertion hole 8 at a predetermined angle with respect to the axis of the shaft, and the space 42 formed between the shaft insertion hole 8, 9 and the shaft 12 is made to communicate with the parallel holes 43*b* through the inclined holes 43*a*.

Further, in this embodiment, two block through holes 43 (inclined holes 43*a*) are formed in the cylinder block 1, 2 on a side opposite to the opening portion 39 through which a working fluid flows into the crank chamber 7 with respect to the axis of the shaft 12 (on a side away from the axis of the shaft 12 as viewed from the opening portion 39) (see FIG. 6(*b*)). In FIG. 1, for facilitating the explanation of the present invention, positions where the inclined holes 43*a* are formed are drawn on a side above the shaft 12. However, as shown in FIG. 6(*b*), by forming the block through holes 43 on a side opposite to the opening portion 39 with respect to the axis of the shaft 12, it becomes possible to introduce a working fluid which flows into the crank chamber 7 uniformly into the plurality of grooves 41 which constitute the bypass passage 33 without being biased to some grooves 41.

Here, a distribution ratio of a working fluid which flows into the compressor from the suction port 30 is set as follows, for example.

Firstly, a cross section of the passage is set such that a flow rate of a working fluid which is directly introduced into the suction chamber 27*a* from the suction port 30 on a front side without via crank chamber 7 and a flow rate of the working fluid which is directly introduced into the suction chamber 27*b* from the suction port 30 on a rear side are respectively set to approximately 35% of a total suction quantity of the working fluid, and a flow rate of the working fluid which is introduced into the crank chamber 7 is set to approximately 30% of the total suction quantity of the working fluid. In this embodiment, a minimum passage cross section of the first suction path through which a working fluid is directly introduced into the suction chamber 27*a*, 27*b* on a front side or a rear side from the suction port 30 is set corresponding to a hole having an approximately ϕ12 (corresponding to a circular hole having a diameter of approximately 12 mm). That is, the first suction path is formed in size at a level where a pressure loss is permissible in terms of performance of the first suction path.

Further, with respect to a flow rate of a working fluid which flows into the crank chamber 7, a flow rate of the working fluid which is introduced into the suction chambers 27*a*, 27*b* through the oil separation passage 32 (the inflow-side side hole 32*b*, the axial hole 32*a*, the outflow-side side hole 32*c* formed in the shaft 12) is set to approximately 40% (approximately 12% of the total suction flow rate), and a flow rate of the working fluid which is introduced into the suction chambers 27*a*, 27*b* through the bypass passage 33 is set to approximately 60% (approximately 18% of the total suction flow rate).

Accordingly, in the above-mentioned constitution, although the flow rate of a working fluid which flows into the crank chamber 7 is decreased by providing the first suction path where a working fluid is directly introduced into the suction chambers 27*a*, 27*b* from the suction port 30, the second suction path which introduces the working fluid into the suction chambers 27*a*, 27*b* from the crank chamber 7 is constituted such that the bypass passage 33 and the oil separation passage 32 are arranged parallel to each other. Accordingly, compared to a conventional constitution where the second suction path is constituted of only the oil separation passage which introduces a working fluid into the suction chambers 27*a*, 27*b* through the inside of the shaft 12*a*, a quantity of the working fluid which flows into the crank chamber 7 can be relatively increased.

Further, the working fluid which is introduced into the crank chamber is introduced into the suction chamber in a divided manner through the bypass passage and the oil separation passage and hence, even when a quantity of a working fluid to be introduced into the crank chamber is increased, a quantity of the working fluid which passes through the inflow-side side hole 32*b* formed in the shaft 12 (a flow speed of the working fluid which passes through the inflow-side side hole 32*b*) can be suppressed.

Accordingly, it is possible to ensure cooling of the inside of the crank chamber by increasing a quantity of a working fluid which flows into the crank chamber. Further, a part of the working fluid which is introduced into the crank chamber is introduced into the suction chamber through the bypass passage 33 and hence, a flow speed of the working fluid which flows into the inflow-side side hole 32*b* of the shaft 12 can be suppressed whereby oil is separated from an oil-containing refrigerant in the inside of the crank chamber 7 due to a centrifugal separating operation generated by the rotation of the shaft 12 thus making oil remain in the crank chamber.

Here, a refrigerant which is directly sucked into the suction chamber 27*a*, 27*b* from the suction port 30 without via the crank chamber 7 is compressed in a state where the refrigerant keeps containing oil therein, and is directly discharged to an external refrigerating cycle. In this case, when the refrigerant circulates through the refrigerating cycle and the refrigerant is sucked into the compressor again, a part of the refrigerant is distributed to the second suction path and oil is separated from the refrigerant. Accordingly, in the course where such a process is continuously performed, oil which circulates in the refrigerating cycle is surely separated and is held in the crank chamber.

Further, according to the above-mentioned constitution, the grooves 41 which constitute the bypass passage 33 are formed between the thrust bearing 21, 22 which rotatably supports the swash plate 20 and the thrust bearing receiving surface 40 which is formed on the cylinder block 1, 2 which receives the thrust bearing. Accordingly, the thrust bearings 21, 22 can be preferentially cooled thus reducing the wear of portions in the vicinity of the thrust bearings and, at the same time, abrasion powder generated by the wear of the thrust bearings can be discharged from the crank chamber via the bypass passage.

Further, the bypass passage 33 is formed so as to bypass the plain bearing 10, 11 and hence, there is no possibility that abrasion powder in a working fluid which flows through the bypass passage 33 is introduced into the plain bearing thus ensuring the smooth rotation of the shaft 12. Further, as described above, the bypass passage 33 is constituted of: the grooves 41; the space formed between the shaft 12 and the shaft insertion hole 8, 9 into which the shaft 12 is inserted; and the block through holes 43 which are formed in the cylinder block 1, 2 in a state where the block through holes 43 open on the inner peripheral surface of the shaft insertion hole 8, 9, to thereby provide an intricate structure so that an outflow of oil which flows out to the suction chamber from the crank chamber 7 through the bypass passage 33 can be suppressed.

In the above-mentioned embodiment, the explanation has been made with respect to the case where the present invention is applied to the piston-type fixed displacement compressor provided with the double-headed piston. However, the present invention is also applicable to a fixed displacement compressor where a single head piston is moved in a reciprocated manner by a swash plate having a fixed inclination angle with respect to a shaft in the same manner as the above-mentioned embodiment.

The invention claimed is:

1. A piston-type compressor comprising:

at least one cylinder block in which cylinder bores which face a crank chamber are formed;

pistons which each slides in the inside of the cylinder bore in a reciprocating manner;

at least one cylinder head in which a suction chamber and a discharge chamber are formed, the cylinder head being jointed to the cylinder block by interposing a valve plate therebetween;

a shaft which penetrates the crank chamber and is rotatably supported on the cylinder block;

a swash plate which is housed in the crank chamber and is rotatable due to the rotation of the shaft so as to reciprocate the pistons; and a suction port for sucking a working fluid and a discharge port for discharging the working fluid which are formed in the cylinder block or the cylinder head, wherein the working fluid which is sucked from the suction port is introduced into the suction chamber, and is discharged from the discharge port through the discharge chamber after being compressed by the pistons, being characterized in that at least an axial hole which is formed along the axial direction of the shaft, and a side hole which communicates with the axial hole and is formed along the radial direction of the shaft and opens to the crank chamber are formed in the shaft, a first suction path which directly introduces the working fluid flowed from the suction port into the suction chamber without via the crank chamber is provided, and a second suction path which introduces the working fluid flowed from the suction port into the suction chamber via the crank chamber is provided, and the second suction path includes: an oil separation passage where a working fluid is introduced into the suction chamber from the crank chamber via the side hole and the axial hole formed in the shaft; and a bypass passage where a working fluid is introduced into the suction chamber from the crank chamber through the cylinder block without via the inside of the shaft.

2. The piston-type compressor according to claim 1, wherein the bypass passage includes: a groove which is formed between a thrust bearing which rotatably supports the swash plate; and a thrust bearing receiving surface which receives the thrust bearing and is formed on the cylinder block.

3. The piston-type compressor according to claim 2, wherein the bypass passage is constituted of: the groove which is formed between the thrust bearing which rotatably supports the swash plate and a thrust bearing receiving surface formed on the cylinder block; a space which communicates with the groove and is formed between the shaft and a shaft insertion hole into which the shaft is inserted; and a through hole which is formed in the cylinder block in a state where the through hole opens in an inner peripheral surface of the shaft insertion hole.

4. The piston-type compressor according to claim 1, wherein the shaft is rotatably supported on the cylinder block by way of a plain bearing, and the bypass passage is formed in the cylinder block such that the bypass passage bypasses the plain bearing.

5. The piston-type compressor according to claim 3, wherein the through hole which is formed in the cylinder block is at least one block through hole formed on a side opposite to a portion where a working fluid flows into the crank chamber with respect to an axis of the shaft.

6. The piston-type compressor according to claim 2, wherein the shaft is rotatably supported on the cylinder block by way of a plain bearing, and the bypass passage is formed in the cylinder block such that the bypass passage bypasses the plain bearing.

7. The piston-type compressor according to claim 3, wherein the shaft is rotatably supported on the cylinder block by way of a plain bearing, and the bypass passage is formed in the cylinder block such that the bypass passage bypasses the plain bearing.

* * * * *